United States Patent [19]

Wilde

[11] 3,948,819

[45] Apr. 6, 1976

[54] CLEANING COMPOSITION

[75] Inventor: Arthur G. Wilde, St. Paul, Minn.

[73] Assignee: Minnesota Mining and Manufacturing Company, St. Paul, Minn.

[22] Filed: June 18, 1973

[21] Appl. No.: 370,785

Related U.S. Application Data

[63] Continuation-in-part of Ser. No. 39,143, May 20, 1970, abandoned.

[52] U.S. Cl. ..... 252/545; 252/89 R; 252/135; 252/156; 252/173; 252/526; 252/DIG. 1; 252/DIG. 17

[51] Int. Cl.[2]... C11D 1/34; C11D 1/66; C11D 3/10; C11D 3/36

[58] Field of Search ..... 252/DIG. 1, 89, 135, 152, 252/139, 312, 351, 526, 173, 545, 156

[56] References Cited

UNITED STATES PATENTS

| | | | |
|---|---|---|---|
| 2,597,702 | 5/1952 | Benning | 260/461 |
| 2,968,621 | 1/1961 | Teeter | 252/49.5 |
| 3,083,224 | 3/1963 | Brace | 260/461 |
| 3,094,547 | 6/1963 | Heine | 260/461 |
| 3,419,501 | 12/1968 | Levy | 252/135 X |
| 3,210,287 | 10/1965 | Kelly | 252/139 |
| 3,282,843 | 11/1966 | Alburger | 252/52 |
| 3,429,822 | 2/1969 | Grunewald | 252/99 |
| 3,549,539 | 12/1970 | Mallows | 252/99 |
| 3,553,130 | 1/1971 | Stratton | 252/8.55 |
| 3,585,145 | 6/1971 | Fethke | 252/99 |
| 3,840,465 | 10/1974 | Knowles | 252/90 |

FOREIGN PATENTS OR APPLICATIONS

| | | | |
|---|---|---|---|
| 159,335 | 5/1952 | Australia | 252/132 |
| 698,560 | 11/1964 | Canada | 252/139 |
| 2,125,836 | 12/1971 | Germany | 252/89 |

OTHER PUBLICATIONS

"Tergitol Surfactants" bulletin published by Union Carbide, 1961, pp. 3, 8 and 12.

"TLF-1800 Fluorochemical" bulletin of E. I. Dupont & Co., Oct. 1968, 5 pages.

"ZONYL S-13 Fluorochemical Surfactant" publication of E. I. Dupont & Co., Jan. 1966, 8 pages.

"Considerations in the use of Nonionic Surface-Active Agents" by C. E. Colwell et al., *American Dyestuff Reporter*, Vol. 50, No. 18, pp. 39–42, Sept. 4, 1961.

*Primary Examiner*—Dennis L. Albrecht

*Attorney, Agent, or Firm*—Alexander, Sell, Steidt and DeLaHunt

[57] ABSTRACT

Cleaning compositions, having particular utility in cleaning aircraft, based on a synergistic combination of nonionic polyethoxylated surfactants. The inclusion of a fluoroaliphatic phosphate in the composition imparts resoilresistance to the cleaned surface.

4 Claims, No Drawings

CLEANING COMPOSITION

CROSS-REFERENCE TO RELATED APPLICATION

This application is a continuation-in-part of Ser. No. 39,143, filed May 20, 1970 now abandoned.

BACKGROUND OF THE INVENTION

This invention relates to cleaning compositions, especially to surfactant-based compositions having utility in cleaning aluminum surfaces.

Cleaning the exterior surface of modern aircraft is important from the standpoint of both beauty and performance. The aluminum skin is frequently contaminated with engine fuel, carbon and grease, forming a coating which is hardened by exposure to sunlight and air. Even more important than the decrease in aesthetic appeal is the increase in surface roughness, which is felt to cause a substantial increase in the amount of fuel consumption. In some instances, the contaminants actually corrode the aluminum, reducing its structural strength and decreasing the aircraft's margin of safety.

For at least the last two decades, it has been common to clean soiled aircraft surfaces with an aqueous composition containing surfactants, organic solvents, inorganic builders such as phosphates and silicates, and water. The non-aqueous portion of such compositions is typically about 2–4% of their total weight. Although such compositions are effective to a degree in removal of soil, the water-insoluble solvents tend to leave a dulling film and also attack painted insignia. Further, disposal of the spent cleaning solution creates a serious pollution problem. The organic solvents are detrimental to animal life, and the inorganic phosphate builders promote the undesirable growth of algae when disposed of via a sewer system. Perhaps as disturbing as any other aspect of cleaning aircraft, is the fact that the cleaned surface quickly becomes resoiled with the very type of dirt which had been removed.

SUMMARY

The present invention provides a novel cleaning composition having particular utility in the removal of soil from aircraft surfaces. This composition is more effective than the prior art type compositions and does not contain nonwater soluble organic solvent or phosphate builders. In addition to the specific utility indicated, the novel composition is also highly effective in cleaning a wide variety of other substrates, including painted surfaces, vinyl, glass, linoleum, asphalt tile, lacquer finishes, stainless steel, etc.

The cleaning composition of the present invention is an aqueous solution containing, per liter, at least 1 gram of a surfactant system consisting essentially of at least two nonionic polyethoxylated surfactants having specifically different characteristics and functioning synergistically. The first nonionic surfactant contains from 35 to 55% oxyethylene units by weight. The second nonionic surfactant contains at least 55% oxyethylene units by weight but not less than 10% more oxyethylene units by weight than does the first surfactant. The mol ratio of the first surfactant to the second surfactant is in the range of about 4:1 to 1:3. The surfactants which have been discovered, quite unexpectedly, to provide synergistic cleaning properties are selected from the group consisting of polyethoxylated alkyl phenols, polyethoxylated secondary alcohols, polyethoxylated fatty acids and polyethoxylated sorbitan fatty acids.

Typically, the non-aqueous portion of the cleaning compositions of the invention will be in the range of 1 to 20% by weight of the total, when they are used for cleaning. A convenient means of packaging the cleaning solutions for sale is as a concentrated solution which may contain from 10 to 100% non-aqueous constituents.

In a particularly preferred embodiment of the invention, each liter of diluted cleaning composition contains at least 0.1 millimol, and preferably at least 0.3 millimol, of an anti-resoiling agent which contains at least one fluoroaliphatic radical and at least one phosphate or substituted phosphate radical. The preferred anti-resoiling agents are $C_8F_{17}SO_2N(C_2H_5)C_2H_4OPO(OH)_2$, $[CF_3(CF_2)_{5\text{-}14}C_2H_4O]PO[ONH_2(C_2H_4OH)_2]$ and $[CF_3(CF_2)_7SO_2N(C_2H_5)C_2H_4O]_2PO(ONH_4)$. U.S. Pat. Nos. 2,597,702, 3,083,224, and 3,094,547 disclose the preparation of such fluoroaliphatic phosphates.

The cleaning compositions of the invention are preferably made alkaline to enhance cleaning. Typically, the pH will be adjusted to about 9–12 by addition of minor amounts (e.g., 0.1–5% by weight of the total) of a suitable compatible alkaline compound. The pH should preferably be less than about 11 for cleaning aluminum. Solutions more alkaline than pH 11 may corrode aluminum. Such compounds include potassium or sodium carbonate, potassium or sodium borates, alkanol amines such as mono- or diethanol amines, etc.

The cleaning compositions of the invention may contain minor amounts of other additives for a variety of purposes. A hydrogen embrittlement preventor such as sodium nitrate, propargly alochol, or di-o-tolylthiourea may be included in an effective amount, typically 1–2% by weight of the total. Other optional additives include, coloring agents, odorants, non-phosphate and non-silicate builders, and water soluble solvents, etc.

DESCRIPTION OF PRESENTLY PREFERRED EMBODIMENTS

Understanding of the invention will be further facilitated by referring to the subsequent examples, which indicate without thereby limiting, ways in which the invention may be practiced.

In order to provide a comparative evaluation of different cleaning compositions, it has been found effective to utilize standard aluminum test panels which have been provided with a uniform test surface, a standard type of synthetic soil to be applied to the panels, a standard method of cleaning soiled panels, and a standard method of measuring the effectiveness of cleaning. As a preliminary to the examples, these procedures will now be discussed.

A No. 2024 T6 aluminum sheet approximately 0.040 inch thick is cleaned and provided with a uniform matte finish by twice passing it under a rapidly rotating, axially oscillating low density fibrous nonwoven abrasive wheel (e.g., of the type commercially available under the Registered Trademark designation "Scotch-Brite" brand "Redi-Load" compressed brush S-Super Fine) while applying medium pressure and flooding the surface with water. The purpose of the treatment with a low density abrasive material is to provide a mildly roughened, diffusely reflectant surface to which soil will adhere when applied as subsequently described.

Each face of the sheet is then protectively covered with pressure-sensitive adhesive tape, the sheet cut into 9-inch × 2-inch panels, and the tape removed to provide test panels. Three panels are employed for each test.

Following the procedure outlined in U.S. Federal Specification P-D-220A (April, 1962), five readings are made of the diffuse reflectance of each panel, and the readings averaged for each panel. In this test, a beam of light is directed at 90° to the surface of the aluminum sheet, and the amount of light which is diffusely reflected outside the confines of a cylinder defined by the beam of light, is measured; a specularly reflective surface would have a diffuse light reading of zero, as would a completely light-absorptive surface. The meter is adjusted so that the reading for a particular control panel used for each test is 90 reflectance units, it being recognized that any given panel may deviate slightly from that value.

To the surface of the panel, prepared and measured as described in the preceding paragraphs, there is next applied a synthetic aircraft soil of the type recommended by the U.S. Air Force. This synthetic soil is prepared by intimately blending the following ingredients to form a composition having a viscosity of about 45,000 cps.

| Ingredient | Parts by weight |
|---|---|
| anhydrous lanolin | 0.2 |
| carbon black | 5.0 |
| magnesium silicate | 4.0 |
| lubricating oil (SAE viscosity 85–100) | 5.0 |
| kerosene | 20.0 |

A small paint brush is used to apply about 0.7 gram of soil to one side of each panel. The coated panel is then placed in a 200°F. oven for 16 hours, removed, and wrapped in onion skin paper until it is to be cleaned.

A soiled panel is cleaned in a standard manner with the cleaning composition under evaluation, preferably using a Gardner Washability Machine. In this procedure the soiled panel is mounted in a tray and 5 ml of cleaning composition applied and allowed to stand for 2 minutes. A 2 × 4 × ½ inch pad of nonwoven fibrous buffering material is then attached to the lower face of a head weighing one pound and oscillated through a 13-inch stroke at the rate of 70 complete cycles per minute, applying 10 ml more of cleaning composition at the start of the cleaning cycle. After 15 cycles, the panel is removed, rinsed with tap water, air dried, and its reflectance measured. The effectiveness of cleaning is determined as the loss in diffuse reflectance units of the cleaned panel compared to the initial panel; i.e., the lower this figure, the more effective the cleaning. Using the test procedure just described, it was determined that the reflectance of the panel cleaned with the surfactant:solvent:builder:water composition most commonly used in the aircraft industry today was 29 units less than that of the initial reflectance value. After 8 cycles of soiling and cleaning with this composition, the final reading was 12 reflectance units lower than the value after the first cleaning. Further soiling and cleaning cycles did not change this figure.

EXAMPLE 1

A cleaner concentrate was prepared by blending 51 parts of water, 13 parts of a first surfactant which was an ethoxylated $C_{11-15}$ secondary aliphatic alcohol containing 5 ethylene oxide units (52% oxyethylene units by weight), 26 parts of a second surfactant which was an ethoxylated secondary $C_{11-15}$ aliphatic alcohol containing 12 ethylene oxide units (73% oxyethylene units by weight), 3 parts of $C_8F_{17}SO_2N(C_2H_5)OPO(OH)_2$, 4 parts $NaNO_3$ and 3 parts of $K_2CO_3$. The resultant concentrate had a viscosity of 68 cps at room temperature. The first and second surfactants in the above concentrate are present in equimolar amounts.

One part of the cleaning concentrate was diluted with 99 parts of water and used to clean aluminum panels which had been prepared, measured for reflectance, and soiled, all as described hereinabove. Reflectance was found to be 6 units less than the initial value, and the cleaned panels were visually indistinguishable from those which had never been soiled. After being subjected to seven soiling and cleaning cycles, the reflectance value was only 2 units less than that of the initially prepared panel.

Analysis indicated that the fluoroaliphatic phosphate had deposited on the cleaned panel in an amount equal to about 3 milligrams per square meter. To demonstrate the effectiveness of this compound in helping prevent subsequent resoiling, the cleaned panel was dried, placed in a vertical position and sprayed from a wash bottle containing the synthetic aircraft soil which had previously been used. After the panel was allowed to drain and air dry without rinsing, the panel was found to be 5 units less than that of the initially cleaned panel. When a soiled panel was initially cleaned with a composition identical to that of the present example except for omission of the fluoroaliphatic phosphate, the reflectance value was about 12 units less than the initial reading, and repeated soiling and recleaning cycles did not change this value. When the cleaned panel was sprayed with synthetic aircraft soil and allowed to drain, however, it was found that the surface appeared black, and the reflectance value was about 40 units less than that of the cleaned panel.

When a panel which had been initially cleaned with the fluoroaliphatic phosphate-containing cleaning composition of this example was thereafter repeatedly resoiled and recleaned with a composition which was identical except for omission of the fluoroaliphatic phosphate, there was a gradual increase in reflectance loss and a corresponding decrease in resoil resistance. Subsequent cleaning with the fluoroaliphatic phosphate-containing cleaning composition was able to restore the original condition.

When the amount of fluoroaliphatic phosphate in the cleaning concentrate is reduced to about 0.1 part (0.015 millimol per liter of diluted composition), cleaning efficiency of the diluted solution is also reduce, although the cleaned panel shows a lower reflectance loss than a panel cleaned with a composition containing no fluoroaliphatic phosphate. Increasing the amount of fluoroaliphatic phosphate in the concentrate above about 3 parts (0.5 millimol per liter of diluted composition) increases cost without imparting any substantial additional resoil resistance to the diluted cleaning composition.

EXAMPLE 2–5

In order to determine useful mol ratios of the first surfactant to the second surfactant, a series of cleaning compositions of each of the useful surfactants was prepared and evaluated. Each cleaning composition consisted of a mixture of the specified surfactants in the specified mol range, and potassium carbonate, all at the concentration of the diluted test solution described in Example 1. Results are tabulated below:

EXAMPLE 2

Ethoxylated Secondary Aliphatic Alcohol

Surfactants: (1) $C_{11-15}$ secondary aliphatic alcohol (52% ethylene oxide) and (2) $C_{11-15}$ secondary aliphatic alcohol (73% ethylene oxide).

| Example 2 | Mol ratio of first surfactant to second surfactant | Loss in Reflectance, units |
|---|---|---|
| a | Infinity | 49 |
| b | 10/1 | 51 |
| c | 7/1 | 51 |
| d | 5/1 | 46 |
| e | 3.5/1 | 15 |
| f | 2/1 | 15 |
| g | 1/1 | 15 |
| h | 1/2 | 23 |
| i | 1/3 | 24 |
| j | 1/5 | 39 |
| k | 1/7 | 41 |
| l | 1/10 | 41 |
| m | 0 | 43 |

A loss in reflectance units of 24 or less is better than that obtained with the best commercial cleaner known to the inventor herein. As is shown in Example 1, however, still better results in cleaning efficiency are obtained when a fluoroaliphatic compound is included in the composition.

EXAMPLE 3

Ethoxylated Alkyl Phenols surfactants: (1) octyl phenol (51% ethylene oxide) and (2) octyl phenol (77% ethylene oxide),

| Example 3 | Weight Ratio Surfactant (1) : Surfactant (2) | Reflectance Loss |
|---|---|---|
| a | Infinity | 44 |
| b | 10/1 | 41 |
| c | 5/1 | 50 |
| d | 4/1 | 8 |
| e | 3/1 | 4 |
| f | 2/1 | 2 |
| g | 1/1 | 6 |
| h | 1/2 | 9 |
| i | 1/3 | 12 |
| j | 1/4 | 25 |
| k | 1/5 | 32 |
| l | 1/10 | 30 |
| m | 0 | 31 |

EXAMPLE 4

Polyethoxylated Fatty Acid Esters

Surfactants: (1) oleic acid (43% ethylene oxide) and (2) oleic acid (70% ethylene oxide).

| Example 4 | Weight Ratio Surfactant (1) : Surfactant (2) | Reflectance Loss |
|---|---|---|
| a | Infinity | 56 |
| b | 10/1 | 48 |
| c | 5/1 | 45 |
| d | 4/1 | 36 |
| e | 3/1 | 22 |
| f | 2/1 | 21 |
| g | 1/1 | 17 |
| h | 1/2 | 20 |
| i | 1/3 | 21 |
| j | 1/4 | 42 |
| k | 1/5 | 45 |
| l | 1/10 | 45 |
| m | 0 | 56 |

EXAMPLE 5

Polyethoxylated Sorbitan Fatty Acid Esters

Surfactants: (1) sorbitan oleate (35% ethylene oxide) and (2) sorbitan oleate (65% ethylene oxide.

| Example 5 | Weight Ratio Surfactant (1) : Surfactant (2) | Reflectance Loss |
|---|---|---|
| a | Infinity | 65 |
| b | 10/1 | 50 |
| c | 4/1 | 41 |
| d | 3/1 | 27 |
| e | 2/1 | 30 |
| f | 1/1 | 24 |
| g | 1/2 | 30 |
| h | 1/3 | 33 |
| i | 1/4 | 50 |
| j | 1/10 | 51 |
| k | 0 | 53 |

EXAMPLE 6

It might be supposed that the blending of two surfactants in the practice in this invention merely results in a surfactant system which has an effective oxyethylene weight percent corresponding to the weighted average of the two surfactants themselves. With respect to this possibility, a series of cleaning compositions, identical to that of Example 2 in terms of chemical family and molar concentration of surfactant, but using only a single surfactant, was prepared. Results are set forth in the table below:

| Number of ethylene oxide units in surfactant | Loss in reflectance, units |
|---|---|
| 3 | 44 |
| 5 | 42 |
| 7 | 24 |
| 12 | 41 |
| 20 | 44 |

It will be noted that if a single surfactant were to be used, it would, indeed, be a compromise between the first and second surfactants in terms of oxyethylene unit content. More significant, however, is the fact that the cleaning efficiency of compositions based on a single surfactant is far less than the cleaning efficiency obtained with the preferred compositions of Examples 2 and not better than that of the prior art.

EXAMPLE 7

Example 1 was repeated, substituting for the fluoroaliphatic phosphate of Example 1, $[CF_3(CF_2)_5-$ $_{14}C_2H_4O]PO[ONH_2(C_2H_4OH)_2]$ commercially available as "Zonyl" RP. Cleaning efficiency and resoil resistance were virtually identical.

EXAMPLE 8

Example 1 was repeated, substituting for the fluoroaliphatic phosphate of Example 1, $[CF_3(CF_2)_7SO_2N(C_2H_5)C_2H_4O]_2PO(ONH_4)$. Cleaning efficiency and resoil resistance were virtually identical.

EXAMPLE 9

Example 1 was repeated, substituting for the first surfactant 0.24 gram of an ethoxylated octyl phenol containing 5 ethylene oxide groups (commercially available as "Triton" X-45) and for the second surfactant 0.45 gram of an ethoxylated octyl phenol containing 12–13 ethylene oxide groups, commercially available as "Triton" X-102. Loss in reflectance after the first cleaning of the panel was found to be 11 units.

Other polyethoxylated aliphatic alcohols can be substituted for the surfactants set forth in Example 1; among these are those based on oleyl alcohol (e.g., the "Brij" 90 series) or lauryl alcohol (e.g., the "Ethosperse" series). Polyoxyethylated dodecyl phenols (e.g., the "Tergitol" 12 P series), polyoxyethylene esters of fatty acids (e.g., the "Ethofat" series based on oleic acid), and the polyoxyethylene derivatives of sorbitan fatty acid esters (e.g., the "Glycosperse" series) may also be used.

EXAMPLE 10

In order to demonstrate the relationship between oxyethylene content of the two surfactants and effectiveness of the cleaning compositions, a series of cleaning compositions was prepared using different surfactants. In each case, equimolar amounts of the two surfactants were present, and the composition was otherwise essentially the same as in Example 2. Results are tabulated below:

| First Surfactant | | Second Surfactant | | Loss in reflectance units |
|---|---|---|---|---|
| Compound ethoxylated | Weight % oxyethylene | Compound ethoxylated | Weight % oxyethylene | |
| octyl phenol | 17* | octyl phenol | 60 | 50 |
| nonyl phenol | 31* | nonyl phenol | 65 | 37 |
| octyl phenol | 37 | octyl phenol | 60 | 15 |
| secondary aliphatic alcohol | 40 | secondary aliphatic alcohol | 52* | 48 |
| " | 40 | " | 61 | 15 |
| " | 40 | " | 73 | 13 |
| " | 52 | " | 73 | 15 |
| " | 52 | octyl phenol | 88 | 15 |
| " | 59* | secondary aliphatic alcohol | 73 | 30 |
| " | 61* | " | 73 | 34 |
| " | 66* | " | 73 | 35 |

*Does not meet the definition set forth on the claims.

What is claimed is:

1. A cleaning composition having particular utility in the removal of soil from aluminum airplane surfaces and substantially preventing the redeposition thereon, consisting essentially of an aqueous solution, each liter thereof having dissolved therein 1. an effective amount for cleaning said airplane surfaces of at least 1 gram of a nonionic surfactant system consisting essentially of
   a. a first ethoxylated nonionic surfactant containing 35–55% oxyethylene units by weight, and
   b. a second ethoxylated nonionic surfactant containing at least 55% oxyethylene units by weight but not less than 10% more oxyethylene units by weight than does the first surfactant, said surfactants being selected from the group consisting of A. polyethoxylated alkyl phenols containing 8 to 12 carbon atoms in the alkyl group, polyethoxylated fatty acids of fatty acids containing about 18 carbon atoms, and polyethoxylated sorbitan esters of fatty acids wherein each fatty acid contains from 12 to 18 carbon atoms wherein the mol ratio of the first ethoxylated surfactant to the second ethoxylated surfactant is about 3.5:1 to 1:3, and
   B. ethoxylated $C_{11-15}$ secondary alkanols wherein the mol ratio of the first ethoxylated surfactant is about 4:1 to 1:3.5, and
2. in a concentration effective to substantially prevent redeposition of soil, at least 0.1 millimol per liter of a fluoroaliphatic phosphate selected from the group consisting of $$C_8F_{17}SO_2N(C_2H_5)C_2H_4OPO(OH)_2$$

$$[CF_3(CF_2)_7SO_2N(C_2H_5)C_2H_4O]PO(ONH_4),$$

and $$[CF_3(CF_2)_{5-14}C_2H_4O]_2PO[ONH_2(C_2H_4OH)_2].$$

2. The cleaning composition of claim 1 further including sufficient potassium carbonate to make the pH of said solution 9–10.8.

3. A cleaning composition having particular utility in the removal of soil from aluminum airplane surfaces, consisting essentially of an aqueous solution, each liter thereof having dissolved therein, in a concentration effective for cleaning said airplane surfaces, at least 1 gram of a nonionic surfactant system consisting essentially of a. a first ethoxylated $C_{11-15}$ secondary alkanol nonionic surfactant containing 35–55% oxyethylene units by weight, and
b. a second ethoxylated $C_{11-15}$ secondary alkanol nonionic surfactant containing at least 55% oxyethylene units by weight but not less than 10% more oxyethylene units by weight than does the first surfactant, wherein the mol ratio of the first ethoxylated alkanol surfactant to the second ethoxylated alkanol surfactant is about 4:1 to 1:3.5, and sufficient potassium carbonate to make the pH of said solution 9–10.8.

4. The cleaning composition of claim 3 further including, in a concentration effective to substantially prevent redeposition of soil, at least 0.1 millimol per liter of a fluoroaliphatic phosphate selected from the group consisting of $C_8F_{17}SO_2N(C_2H_5)C_2H_4OPO(OH)_2$, $[CF_3(CH_2)_{5\text{-}14}C_2H_4O]PO[ONH_2(C_2H_4OH)_2]$ and $[CF_3(CF_2)_7SO_2N(C_2H_5)C_2H_4O]_2PO(ONH_2)$.

* * * * *